US005931588A

United States Patent [19]

Kanai

[11] Patent Number: 5,931,588

[45] Date of Patent: Aug. 3, 1999

[54] WINDING CORE

[75] Inventor: Ryoji Kanai, Iwate-ken, Japan

[73] Assignee: Alps Electric Co., Ltd., Tokyo, Japan

[21] Appl. No.: 09/010,266

[22] Filed: Jan. 21, 1998

[30] Foreign Application Priority Data

Jan. 23, 1997 [JP] Japan ..... 9-010202

[51] Int. Cl.[6] ..... B65H 75/30; B65H 75/00; B65H 75/18

[52] U.S. Cl. ..... 400/242

[58] Field of Search ..... 400/242, 243

[56] References Cited

U.S. PATENT DOCUMENTS 4,423,974 1/1984 Muller et al. ..... 400/242
5,326,182 7/1994 Hagstrom ..... 400/223

FOREIGN PATENT DOCUMENTS 5-8524 1/1993 Japan ..... 400/242

*Primary Examiner*—Edgar Burr
*Assistant Examiner*—Amanda B. Sandusky
*Attorney, Agent, or Firm*—Brinks Hofer Gilson & Lione

[57] ABSTRACT

With a view to making it possible to load a cassette onto a to-be-loaded body in a slack-free good condition of a web accommodated in the cassette, preventing the entry of dust into engaging grooves after the loading of the cassette, and permitting the loading of only such a cassette as is suitable for the loading, there is provided a winding core in a ribbon cassette which accommodates an ink ribbon in a wound-up state, the winding core having a plurality of engaging grooves formed circumferentially in its peripheral surface for engagement with a plurality of engaging projections formed circumferentially at equal intervals on an outer peripheral surface of a winding bobbin of the to-be-loaded body onto which the cassette is to be loaded, the engaging grooves each having side engaging portions for engagement with side faces of each engaging projection and an upper engaging portion for engagement with an axial tip face of each engaging projection in an abutted or covering relation thereto.

5 Claims, 6 Drawing Sheets

WINDING CORE

BACKGROUND OF THE INVENTION

1. Field of the Invention

The present invention relates to a winding core and more particularly a winding core for winding up an ink ribbon accommodated rotatably within a ribbon cassette and having been used in printing.

2. Description of the Prior Art

A thermal transfer printer has heretofore been used in which a predetermined paper is conveyed to between a platen and a thermal head as a recording means while being held between a conveying roller and a pressure roller which is brought into pressure contact with the conveying roller, then the thermal head is moved along the platen while it is kept in pressure contact with the platen through the paper, and heat generating elements of the thermal head are allowed to generate heat selectively in accordance with a recording signal while the ink ribbon is wound up to melt-transfer the ink of the ink ribbon onto the paper, thereby performing a desired recording on the paper.

FIG. 10 is a perspective view showing a schematic construction of a carriage portion 23 of a conventional thermal transfer printer 21. A platen 22 in the shape of a flat plate is disposed near the central part of a frame (not shown) so that its printing surface is substantially perpendicular to the frame, a guide shaft 27 is disposed at a lower position in front of and in parallel with the platen 22, and a carriage 23 is mounted slidably on the guide shaft 27. A driving belt 28 entrained on a pair of pulleys (not shown) is driven by means of a stepping motor (not shown), whereby the carriage 23 is reciprocated on the guide shaft 27.

A thermal head 24 is mounted on a front end portion of the carriage 23 in an opposed relation to the platen 22. The thermal head can move into contact with and away from the platen 22 through an appropriate mechanism. A ribbon cassette 26 (see FIG. 13 ) is loaded onto the upper surface of the carriage 23. The ribbon cassette 26 contains an ink ribbon 25 and conducts the ink ribbon to between the thermal head 24 and the platen 22.

On the carriage 23 are disposed a winding mechanism 29 and a supply mechanism as constituents of an ink ribbon traveling mechanism to move the ink ribbon 25 in the direction of arrow A in the figure.

The ink ribbon traveling mechanism will be further described below.

As shown in FIGS. 11 and 12, the winding mechanism 29 has a winding shaft 30. The lower end portion of the winding shaft 30 is integrally formed with a support flange 32 projecting outward, and a winding gear 31 is loosely fitted on the said lower end portion in a rotatable manner independently of the winding shaft 30. Between the underside of the winding gear 31 and the support flange 32 of the winding shaft 30 is interposed a felt 33 as a slip mechanism, while to the upper end portion of the winding shaft 30 is fixed a winding bobbin 35 which is exposed to the upper surface of the carriage 23 and engaged with a winding hole 34 formed in the ribbon cassette 26. On an outer peripheral surface 36 of the winding bobbin 35 are formed three engaging projections 37 at circumferentially trisected positions, and an annular retaining groove 38 is formed in the lower surface of the winding bobbin 35. On the outer periphery side of the winding shaft 30 is disposed a biasing spring 39 whose upper end portion is retained by the retaining groove of the winding bobbin 35 and whose lower end portion is abutted against the upper surface of the winding gear 31. With the biasing force of the biasing spring 39 the winding gear 31 is brought into pressure contact with the support flange 32 of the winding shaft 30 through the felt 33.

A driving gear 40 fixed to a rotating shaft 48 of a winding motor 47 for the ink ribbon 25 meshes with the winding gear 31. The driving gear 40 is rotated by operation of the ink ribbon winding motor 47 to thereby rotate the winding gear 31. This rotative driving force is transmitted to the winding shaft 30 by virtue of a frictional force of the felt 33 which is created by the biasing force of the spring 39 which is for urging the winding gear 31.

As to the foregoing ink ribbon supply mechanism, an explanation thereof is here omitted.

On the other hand, as shown in FIG. 13, the ribbon cassette 26 loaded onto the upper surface of the carriage 23 is constituted by a case body 41 which is generally rectangular in plan and which comprises a pair of upper case 41A and lower case 41B. In the interior of the case body 41 are disposed a pair of cores 42, 42 supported rotatably, a pair of pinch rollers 43,43 also supported rotatably, and a plurality of guide rollers (not shown) supported rotatably and facing the ribbon traveling path.

The paired cores 42, 42 are each formed in a generally cylindrical shape, and the ink ribbon 25, which has characteristics of heat sublimation or heat melting, is wound from both ends thereof on the outer peripheral surfaces of the cores 42, 42. When the paired cores 42, 42 are loaded onto the carriage 23 of a printer for which the ribbon cassette 26 is used, the core 42 located on the left-hand side in FIG. 13 is used as a winding core 42A for winding a portion of the ink ribbon 25 which portion has been used in recording, while the core 42 located on the right-hand side in the same figure is used as a supply core 42B for supply of the ink ribbon 26 in recording.

In an inner peripheral surface 44 of each core 42 are formed a plurality of engaging grooves 45, 45 in a spline shape spacedly in the circumferential direction. Inside of the inner peripheral surface 44 of the left-hand winding core 42A in FIG. 13 is used as a winding hole 46A for engagement therein of a winding bobbin 35A formed on the carriage 23 of the printer, while inside of the inner peripheral surface of the right-hand supply core 42B in FIG. 13 is used as a supply hole 46B for engagement therein of a delivery bobbin 35B which constitutes the foregoing supply mechanism.

In loading the ribbon cassette 26 onto the carriage 23, there sometimes occurs the case where the ink ribbon 25 accommodated in the ribbon cassette is slightly slack between the paired cores 42, 42. In this case it has so far been required for the user to manually wind up the slack portion of the ink ribbon 25.

Moreover, in the inner peripheral surface 44 of each conventional core 42 are merely formed a plurality of engaging grooves 45, 45 in a spline shape spacedly in the circumferential direction, so after loading of the ribbon cassette onto the carriage 23, dust gets into the engaging grooves 45, 45 from the upper openings, thus resulting in that rotation is not stable during winding of the ink ribbon 25 and the traveling of the ink ribbon becomes unstable, leading to deterioration of the print quality.

Further, since the ribbon cassette 26 can be loaded onto the carriage 23 irrespective of the width of the ink ribbon 25 used, there has been the problem that an ink ribbon 25 of a narrow printing width is accommodated in the ribbon cassette 26.

The above problems are not limited to between the winding bobbin 35 on the carriage 23 of the foregoing thermal transfer printer and the winding core 42A in the ribbon cassette 26 loaded on the carriage, but may occur also between a winding core in a cassette which receives therein a label printing tape or the like in a wound-up state and a winding bobbin formed on a body such as a label printer onto which the cassette is to be loaded.

SUMMARY OF THE INVENTION

It is an object of the present invention to provide a winding core whereby a ribbon cassette can be loaded onto a to-be-loaded body in a good, slack-free condition of an article accommodated therein and which is capable of preventing the entry of dust into engaging grooves after the loading of the cassette and also capable of loading only such a cassette as is suitable for loading onto the body to be loaded.

It is another object of the present invention to provide a winding core in a ribbon cassette which accommodates a web in a wound-up state, the winding core having a plurality of engaging grooves formed circumferentially in its inner peripheral surface for engagement with a plurality of engaging projections formed circumferentially at equal intervals on an outer peripheral surface of a winding bobbin of a to-be-loaded body onto which the cassette is to be loaded, the said engaging grooves each having side engaging portions for engagement with side faces of each said engaging projection and an upper engaging portion for engagement with an axial tip face of each said engaging projection in an abutted or covering relation thereto, thereby permitting the engaging projection to be engaged with the side engaging portions of each engaging groove firmly in the circumferential direction of the winding core, further permitting dust entry into the engaging grooves from above through the upper engaging portion in the axial direction of the winding core, wherein when a ribbon cassette containing a narrow ink ribbon for example and hence unsuitable for loading onto the to-be-loaded body is tried to be loaded onto the said body, the upper engaging portions of the engaging grooves come into abutment against the upper portions of the engaging projections of the winding bobbin to prevent a further entry of the cassette, so that an erroneous loading of the cassette can be prevented.

It is a further object of the present invention to provide a winding core in a ribbon cassette wherein an engaging guide portion is contiguous to each of the side engaging portions of each engaging groove at an insertion-side end portion of the engaging groove, the engaging guide portion being formed as a slant face for causing each engaging projection of the winding bobbin to slide in a relative manner and guiding it into any of the engaging grooves of the winding core, thereby permitting the engaging projection to be easily guided into the engaging projection.

It is a still further object of the present invention to provide a winding core in a ribbon cassette wherein the plural engaging grooves formed in the inner peripheral surface of the winding core are connected together through the above engaging guide portions, whereby the engaging projections can be engaged with the engaging grooves through the engaging guide portions or directly.

It is a still further object of the present invention to provide a winding core in a ribbon cassette wherein the engaging grooves are formed in such a manner that an engaging groove having an engaging groove insertion side at one axial end of the winding core and an engaging groove having an engaging groove insertion side at the opposite end of the winding core are alternately arranged circumferentially at equal intervals, whereby the ribbon cassette can be loaded from any axial side of the winding core relative to the winding bobbin.

It is a still further object of the present invention to provide a winding core in a ribbon cassette wherein engaging guide portions which connect the insertion-side end portions of engaging grooves having insertion sides at the same end portion of the winding core also serve as the upper engaging portion of an engaging groove having an insertion side at the opposite end portion, whereby the winding core having such a waste-free shape can be loaded onto the winding bobbin from any axial side of the core. Besides, since the engaging grooves are formed in the same number as the number of the engaging projections of the winding bobbin, the machining accuracy for the engaging grooves is improved and a stable traveling of an article accommodated in the ribbon cassette, such as ink ribbon, can be attained.

It is a still further object of the present invention to provide a winding core in a ribbon cassette wherein, out of the side engaging portions of each engaging groove, the side engaging portion formed on the winding direction side of the winding core is shorter than the side engaging portion formed on the side opposite to the winding direction of the winding core, and the engaging guide portions are each formed as a slant face between the insertion-side end of a side engaging portion formed on the winding direction side of the winding core and the insertion-side end of a side engaging portion formed on the side opposite to the core winding direction of an adjacent engaging groove having an insertion side in the same direction, whereby the engaging projection abutted against the engaging guide portion can surely be guided to and engaged with the engaging groove formed on the winding direction side of the winding core.

It is a still further object of the present invention to provide a winding core in a ribbon cassette wherein, out of the side engaging portions, the side engaging portion formed on the winding direction side of the winding core is shorter than the side engaging portion formed on the side opposite to the winding direction of the winding core, the engaging guide portion of each side engaging portion is formed at an insertion-side end of the side engaging portion so as to expand from the associated engaging groove, and a tip end of the engaging guide portion contiguous to the side engaging portion formed on the core winding direction side of each engaging groove is connected with a tip end of the engaging guide portion contiguous to the side engaging portion formed on the side opposite to the core winding direction of an adjacent engaging groove, whereby the engaging projection can be engaged with the engaging groove through the engaging guide portion or directly.

It is a still further object of the present invention to provide a winding core in a ribbon cassette wherein the upper engaging portion of each engaging groove is in a steepled shape, whereby the engaging projection can be engaged with the engaging groove through the engaging guide portion or directly.

DETAILED DESCRIPTION OF THE PREFERRED EMBODIMENTS

Winding cores embodying the present invention will be described hereinunder with reference to FIGS. 1 to 9.

Figure 1:
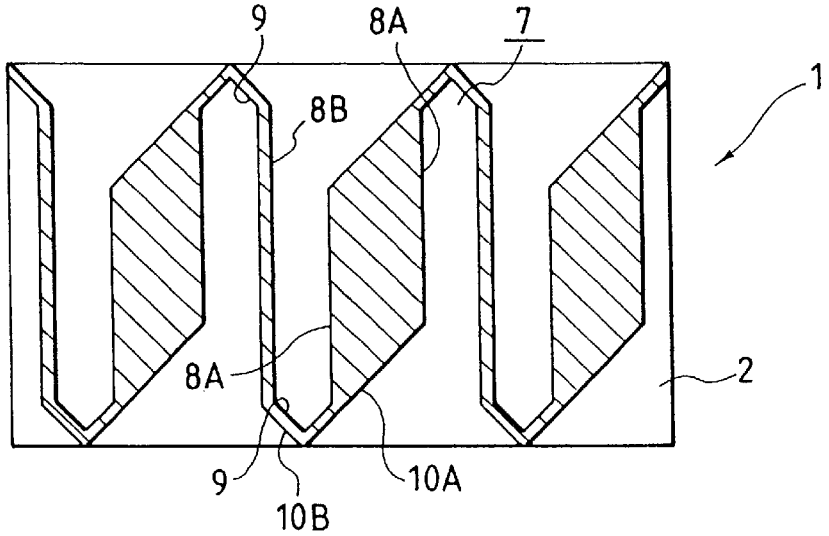
FIG. 1 is a developed view of an inner peripheral surface of a ribbon winding core according to the first embodiment of the present invention.
Figure 2:
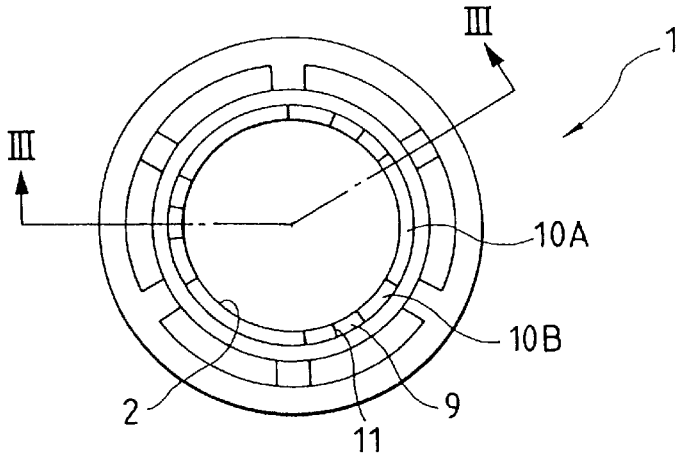
FIG. 2 is a plan view of the ribbon winding core.
Figure 3:
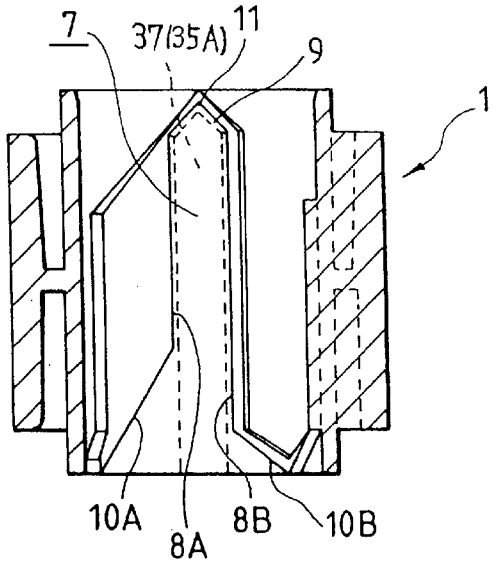
FIG. 3 is a sectional view taken on line III—III in FIG. 2.
Figure 4:
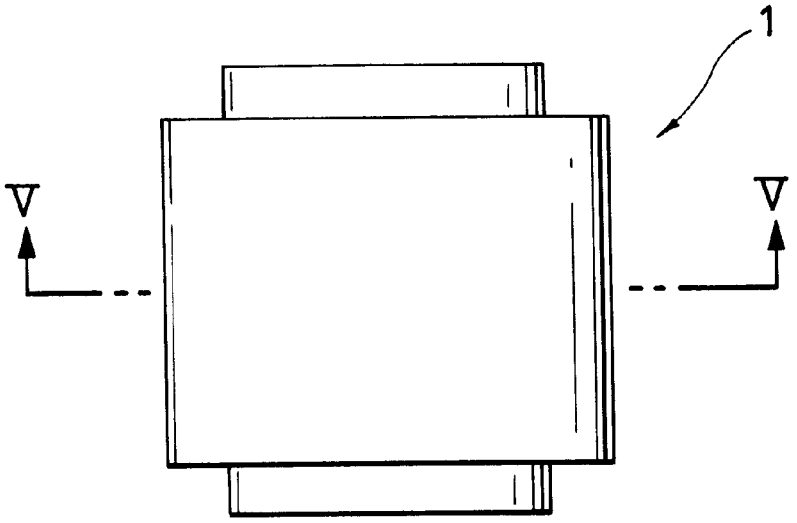
FIG. 4 is a front view of the winding core.
Figure 5:
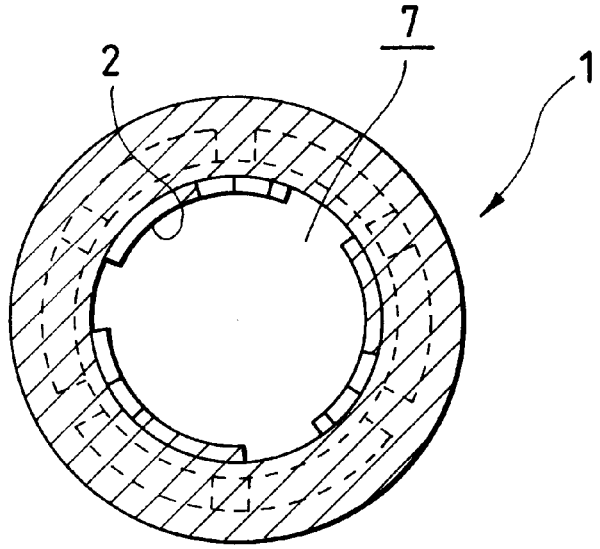
FIG. 5 is a sectional view taken on line V—V in FIG. 4.

FIG. 1 is a developed view of an inner peripheral surface of a winding core according to the first embodiment of the present invention, FIG. 2 is a plan view of the winding core, FIG. 3 is a sectional view taken on line III—III in FIG. 2, FIG. 4 is a front view of the winding core, and FIG. 5 is a sectional view taken on line V—V in FIG. 4.

As shown in FIG. 4, the winding core of the first embodiment, indicated at 1, is formed generally in a cylindrical shape, and in an inner peripheral surface 2 of the winding core 1 are formed a plurality of engaging grooves 7 for engagement with a plurality of engaging projections 37 formed on an outer peripheral surface of a winding bobbin 35A circumferentially at equal intervals, the winding bobbin 35A being disposed on the carriage 23. As shown in FIG. 1, the engaging grooves 7 are formed in such a manner that three engaging grooves having insertion sides on one axial end side of the winding core 1 and three engaging grooves 7 having insertion sides on the opposite end side are alternately formed in the inner peripheral surface 2 circumferentially at equal intervals.

Each of the engaging grooves 7 has side engaging portions 8 for engagement of side faces of each engaging projection 37 and an upper engaging portion 9 for engagement with an axial tip face 11 of the engaging projection in an abutted or covering relation thereto.

Of the side engaging portions 8, the engaging portion 8 (winding-side side engaging portion 8A) formed on the winding direction side of the winding core 1 is shorter than the engaging portion 8 (opposite-side side engaging portion 8B) formed on the side opposite to the winding direction of the core 1. At the insertion-side end of each side engaging portion 8 is formed an engaging guide portion 10 so as to expand from the engaging groove 7. The engaging guide portion 10 is formed as a slant face for causing the engaging projection 37 to slide in a relative manner into the engaging groove 7.

All of the engaging guide portions 10 are designed to expand as above at an equal angle. Each engaging guide portion 10 comprises an engaging guide portion 10A contiguous to the winding-side side engaging portion 8A of each engaging groove 7 and an engaging guide portion 10B contiguous to the opposite-side side engaging portion 8B of an adjacent engaging groove 7 having an insertion side in the same direction. The tip end of the engaging guide portion 10A is connected with the tip end of the engaging guide portion 10B. As a result, a plurality of adjacent engaging grooves 7 having the respective insertion sides in the same direction are connected together in series through the engaging guide portions 10A and 10B.

In the winding core 1 of this embodiment, the upper engaging portion 9 is formed in a steepled shape projecting axially upward in conformity with the shape generally adopted as the shape of axial tip face 11 of each engaging projection 37 formed on the winding bobbin 35A. The upper engaging projection 9 is formed in abutment with or along and spacedly from the axial tip face 11 of the engaging projection 37 to cover the tip face 11.

As to the engaging guide portions 10A and 10B formed so as to expand at the same angle from each engaging groove 7, the slant face of the engaging guide portion 10A contiguous to the winding-side engaging portion 8A shorter than the opposite-side side engaging portion 8B is formed long, while the slant face of the engaging guide portion 10B contiguous to the opposite-side side engaging portion 8B is formed short. The length of the engaging guide portion 10B is almost equal to that of one side which constitutes the upper engaging portion 9, and the above connection is in a steepled shape projecting axially downward. Thus, the engaging guide portion 10 which connects the insertion-side ends of engaging grooves 7 having insertion sides at the same end portion of the winding core 1 is allowed to function also as the upper engaging portion 9.

In each engaging groove 7 of the winding core 1 thus formed, the area of the portion (indicated with cross hatches in FIG. 1) sandwiched between the winding-side side engaging portion 8A of each engaging groove 7 and the winding-side side engaging portion 8A of an adjacent engaging groove 7 having an insertion side on the axially opposite end side of the winding core 1 is set larger than the area of the portion sandwiched between the opposite-side side engaging portion 8B of each engaging groove 7 and the opposite-side side engaging portion 8B of an adjacent engaging groove 7 having an insertion side on the axially opposite end side of the winding core 1.

The operation of this embodiment will be described below.

In loading the cassette 26 having the winding core 1 constructed as above onto the carriage 23, the engaging projections 37 formed on the winding bobbin 35A of the carriage 23 are brought into engagement with the engaging grooves 7 formed in the winding core 1 of the cassette 26.

In this case, if the engaging grooves 7 and the engaging projections 37 are registered with each other, the tip end of each engaging projection 37 comes into direct engagement with the associated engaging groove 7 without abutment against the engaging guide portion 10 formed on the winding core 1.

In many cases, the loading is tried in a somewhat deviated state between the position of the engaging groove 7 and the engaging projection 37. To be more specific, the tip of the engaging projection 37 first abuts the engaging guide portion 10 formed on the core 1 and slides in a relative manner along a slant face of the engaging guide portion 10, resulting in engagement thereof with the engaging groove 7.

At this time, if the tip end of the engaging projection 37 abuts the engaging guide portion 10A which is formed at an end portion of the winding side engaging portion 8A so as to expand from the engaging groove 7, the engaging projection 37 is conducted into the engaging groove 7 positioned on the side opposite to the winding direction of the winding core 1 with respect to the original abutment point of the engaging projection, while sliding along the engaging guide portion 10A which is formed long as in FIG. 1.

Conversely, when the tip end of the engaging projection 37 is abutted against the engaging guide portion 10B which is formed at an end portion of the opposite-side side engaging portion 8B so as to expand from the engaging groove 7, the engaging projection 37 is conducted into the engaging groove 7 positioned on the winding direction side of the winding core 1 with respect to the original abutment point of the engaging projection, while sliding along the engaging guide portion 10B formed as a short slant face as in FIG. 1.

Thus, according to the winding core 1 of this embodiment, the engaging projections 37 formed on the winding bobbin 35A can be surely conducted and engaged with the engaging grooves 7 formed in the winding core 1.

In the winding core 1 of this embodiment, moreover, since the engaging guide portion 10B, which is formed at an end of the opposite-side side engaging portion 8B so as to expand from the engaging groove 7, is short, the possibility of the engaging projection 37 coming into abutment against the engaging guide portion 10A, which is formed at an end of the winding-side side engaging portion 8A so as to expand from the engaging groove 7, or coming into direct engagement with the engaging groove 7 is higher than the possibility of the engaging projection 37 coming into abutment against the engaging guide portion 10B. When the engaging projection 37 abuts the engaging guide portion 10A, which is formed at an end of the winding-side side engaging portion 8A so as to expand from the engaging groove 7, and slides along the engaging guide portion 10A into engagement with the engaging groove 7, the winding core 1 rotates in the direction in which a web accommodated in the cassette, such as ink ribbon, is wound up onto the winding core. As a result, an extra slack of the web is wound and hence the cassette 26 having the winding core 1 is used in a good condition. Conversely, when the engaging projection 37 abuts the engaging guide portion 10B, which is formed at an end of the opposite-side side engaging portion 8B so as to expand from the engaging groove 7, and slides along the engaging guide portion 10B into engagement with the engaging groove 7, the winding core 1 rotates in the direction opposite to the winding direction of the accommodated web such as ink ribbon onto the winding core 1. However, since the rotation is only to a slight distance (in this embodiment only half of the circumferential width of the engaging projection 37), the wound-up web is not slackened to such an extent as causes an obstacle to use.

In the web winding operation, the engaging projection 37 engaged with each engaging groove 7 is sideways abutted on its winding direction side against the winding-side side engaging portion 8A to effect the transfer of a rotating force. In this embodiment, moreover, as noted previously, the portion sandwiched between the winding-side side engaging portion 8A of an engaging groove 7 and the winding-side side engaging portion 8A of an adjacent engaging groove 7 having an insertion side on the axially opposite end side of the winding core 1. Therefore, a high durability is ensured even against a large load imposed on the winding bobbin 35A when winding up the web.

Figure 6:
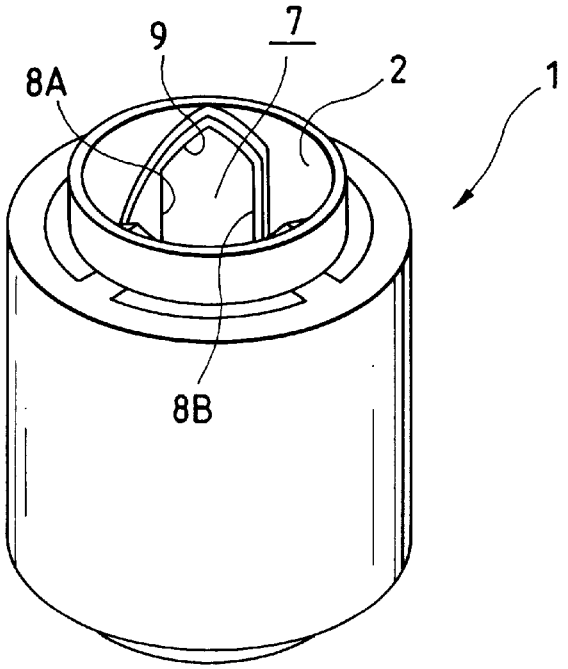
FIG. 6 is a perspective view showing a state in which an engaging projection formed on a winding bobbin of a printer is engaged with an engaging groove formed in the winding core.

FIG. 6 is a perspective view showing a state in which an engaging projection of the winding bobbin 37 is engaged with an engaging groove 7 of the winding core 1. As shown in the same figure and also in FIG. 4, the side engaging portions 8 are engaged with both circumferential side faces of the engaging projection 37, while the upper engaging portion 9 is positioned along the axial tip face 11 of the engaging projection 37 so as to cover the tip face 11.

Therefore, in the axial direction of the winding core 1 it is possible to prevent the entry of dust from above into the engaging groove 7 through the upper engaging portion 9. Moreover, when the cassette 26 contains, for example, a ribbon of a small width and is therefore unsuitable for loading onto the body to be loaded, and when an attempt is made to load such an unsuitable cassette 26 onto the body to be loaded, the upper engaging portion 9 in the winding core 1 of the cassette 26 side comes into abutment against the upper portion of the engaging projection on the winding bobbin 35A side, so that a further entry is inhibited and thus an inappropriate cassette loading can be prevented.

Figure 7:
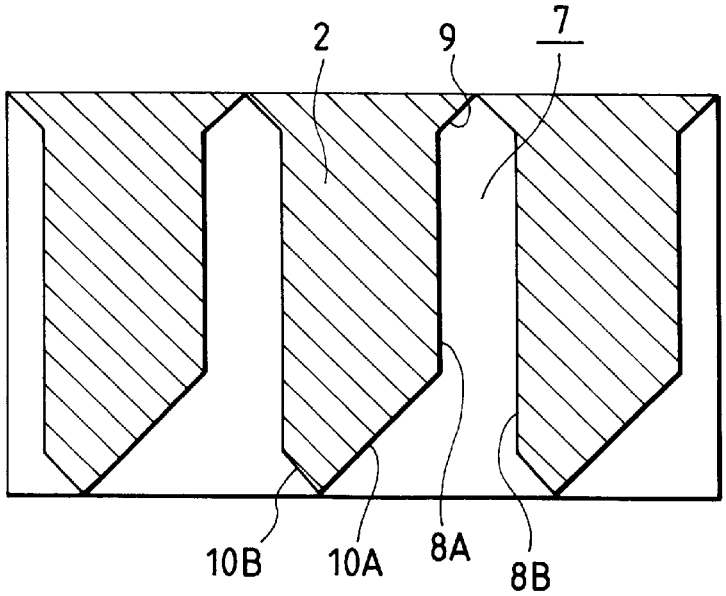
FIG. 7 is a developed view of an inner peripheral surface of a ribbon winding core according to the second embodiment of the present invention.

Further, in the winding core 1 of this embodiment, an engaging groove 7 having an insertion side on one axial end side of the winding core 1 and an engaging groove 7 having an insertion side on the opposite end side are alternately arranged circumferentially at equal intervals, so by turning the cassette 26 having the winding core 1 upside down in the axial direction of the winding core, it is made possible to use both sides of the cassette 26. In this case, upon turning upside down of the cassette 26, the winding core 1 disposed in the cassette is required to function also as a deliver-side core. In both cases the core can be designated the winding core 1. For example, an ink ribbon cassette 26 in a printer is sometimes required to be employable on both sides thereof and in this case it is desirable to use the winding core 1 of this embodiment. FIG. 7 is a developed view of an inner peripheral surface of a winding core according to the second embodiment of the present invention. As shown in the same figure, engaging grooves 7 are formed in the winding core indicated at 1 circumferentially at equal intervals in such a manner that each engaging groove 7 has its insertion side on only one axial end side of the winding core 1. The engaging grooves 7 may be connected together through engaging guide portions 10 in the same way as in the previous embodiment. Even in this case there can be attained the foregoing effects except that it is impossible to use both sides of the cassette 26. The cassette 26 using such a winding core 1 premises the use of only one side thereof. In this case, as to the case on the delivery side, it is not limited to such a core as that of the present invention, but a conventional core may be used.

Figure 8:
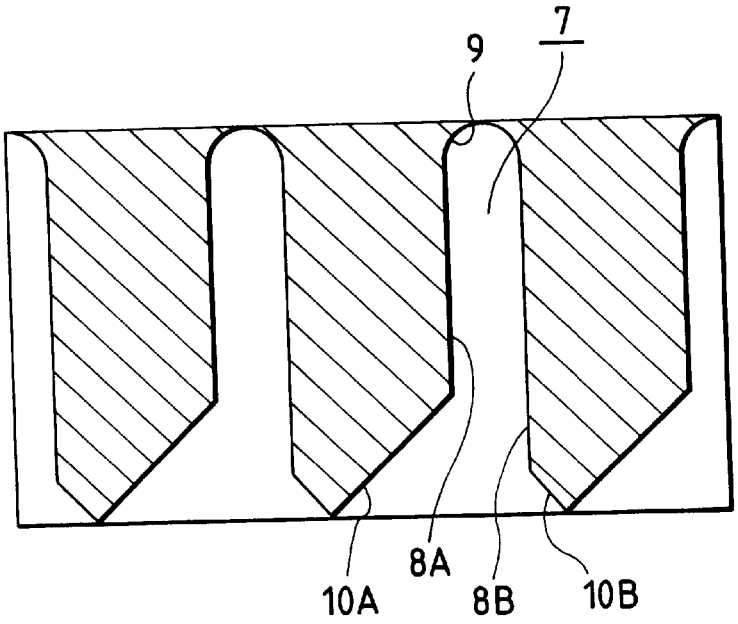
FIG. 8 is a developed view of an inner peripheral surface of a ribbon winding core according to the third embodiment of the present invention.

FIG. 8 is a developed view of a winding core 1 according to the third embodiment of the present invention, in which engaging guide portions 10 which connect insertion-side ends of engaging grooves 7 having their insertion sides at the same end portion of the winding core 1 and an upper engaging portion 9 of an engaging groove 7 having an insertion side at the opposite end portion are not allowed to function as a combination thereof but are formed as separate portions. In this embodiment, the upper engaging portion is formed in a shape of circular arc.

The winding core 1 of this embodiment can also affords the same effects as in the previous embodiments. In order that the winding core 1 can be applied to a both-side employable cassette 26, the engaging grooves 7 may be formed in such a manner that the insertion sides of engaging projections 37 are alternately positioned at both axial ends of the winding core 1.

Figure 9:
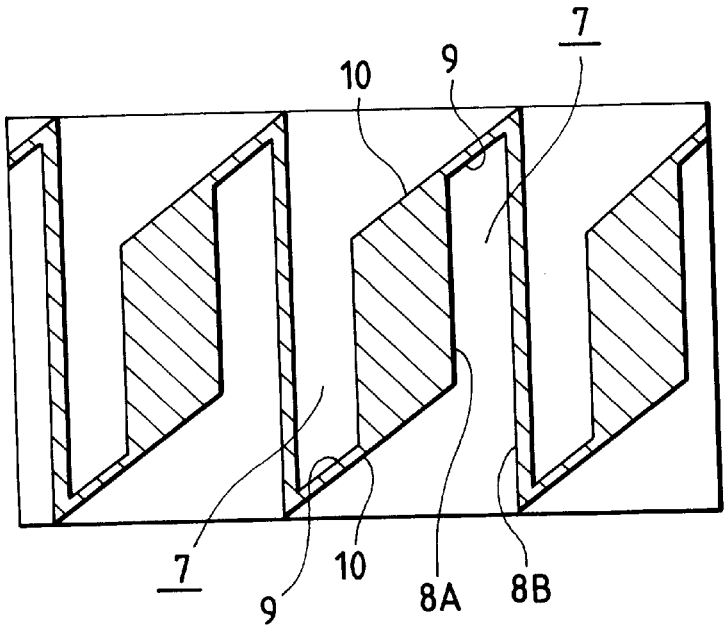
FIG. 9 is a developed view of an inner peripheral surface of a ribbon winding core according to the fourth embodiment of the present invention.
Figure 10:
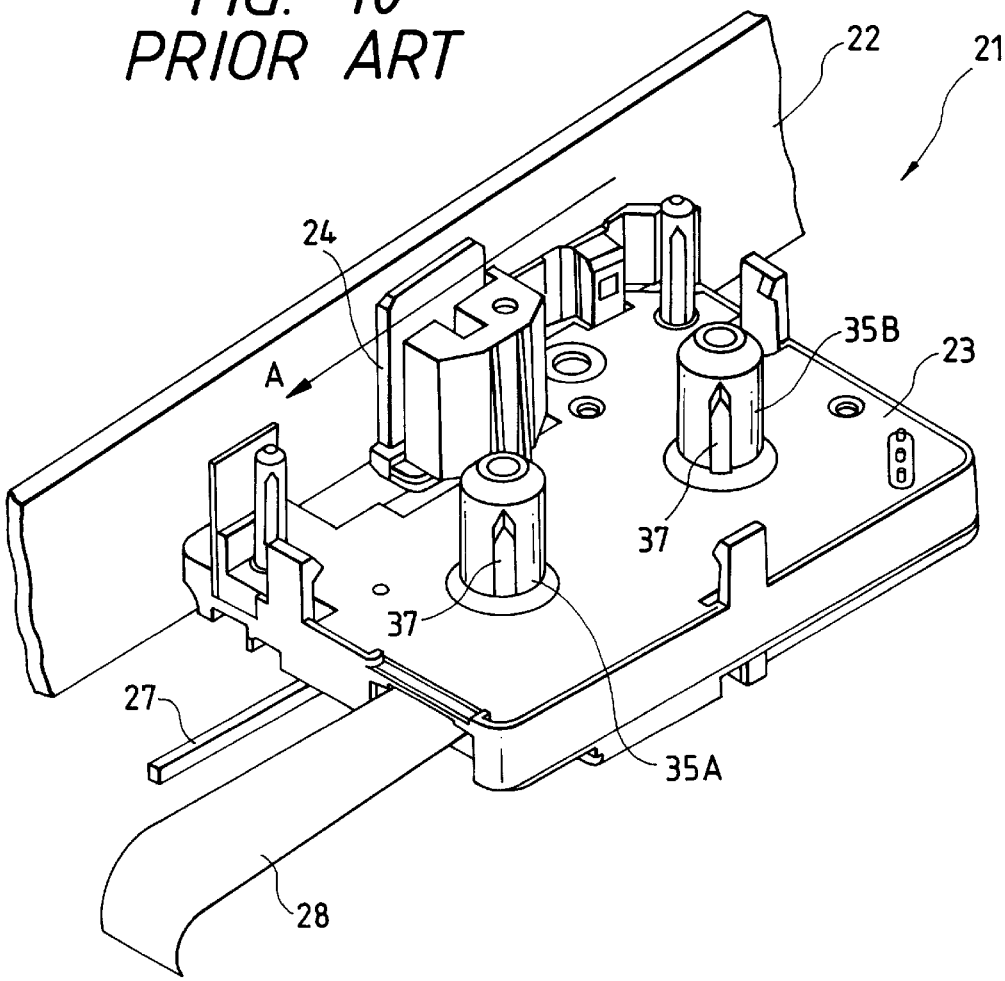
FIG. 10 PRIOR ART
FIG. 10 is a perspective view showing a schematic construction of a carriage portion of a conventional thermal transfer printer.
Figure 11:
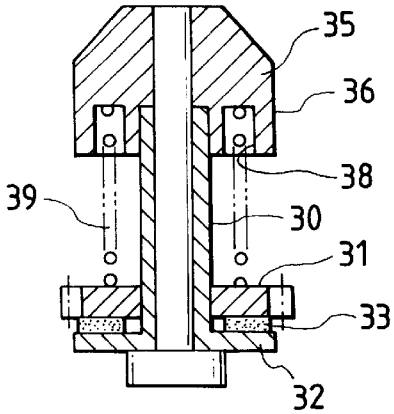
FIG. 11 is sectional view showing a schematic construction of an ink ribbon winding mechanism in the thermal transfer printer.
Figure 12:
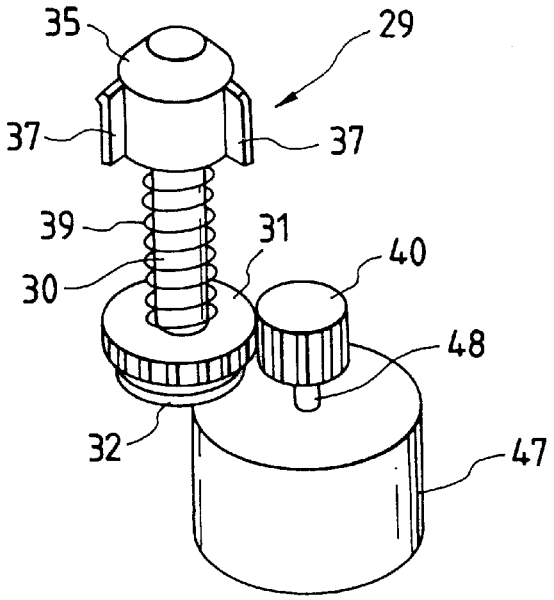
FIG. 12 is a perspective view showing a schematic construction of the ink ribbon winding mechanism.
Figure 13:
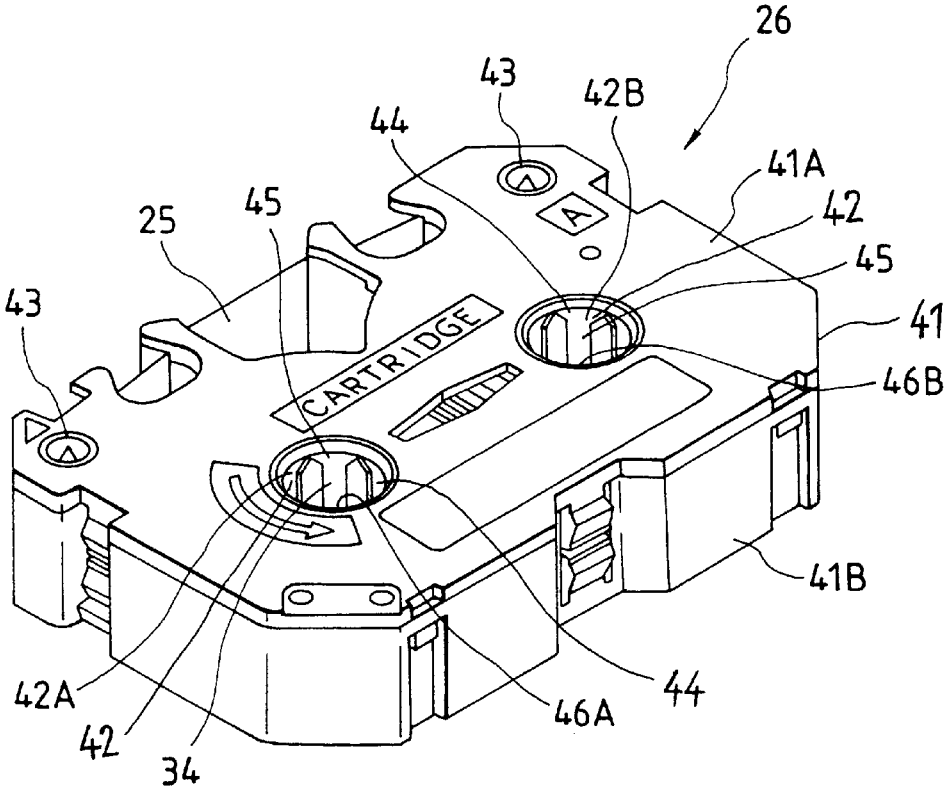
FIG. 13 is a perspective view showing a schematic construction of a ribbon cassette used in the thermal transfer printer.

Further, FIG. 9 is a developed view of a winding core 1 according to the fourth embodiment of the present invention. In the winding core 1 of this embodiment, a winding-side side engaging portion 8A as a constituent portion of each engaging groove 7 formed in an inner peripheral surface 2 of the winding core is formed shorter than an opposite-side side engaging portion 8B as a constituent portion of the engaging groove 7. An engaging guide portion 10 is formed as a slant face between an insertion-side end of the winding-side side engaging portion 8A and that of the opposite-side side engaging portion 8B of an adjacent engaging groove 7 having its insertion side in the same direction. In this embodiment, an upper engaging portion 9 of each engaging groove 7 is formed in conformity with the slant shape of the engaging guide portion 10 so that it can also function as the engaging guide portion 10.

When each engaging projection 37 slides on the engaging guide portion 10 into engagement with the engaging groove 7, the winding core 1 is sure to rotate in the direction to wind up thereon a web-like accommodated article such as ink ribbon located on the outer peripheral surface of the core. Consequently, an extra slack of the web is eliminated and the cassette 26 having the winding core 1 is used in a good condition. It is needless to say that the foregoing effects can also be attained such as inexpensive manufacture and easy and reliable engagement of each engaging projection 37 into the engaging groove 7. In order that the winding core 1 can be applied to a both-side employable cassette 26, the engaging grooves 7 may be formed in such a manner that the insertion sides of engaging projections 37 are alternately positioned at both axial ends of the winding core 1.

According to the winding core of the present invention, as set forth above, the cassette can be loaded onto the carriage in a slack-free good condition of the web accommodated in the cassette. Besides, it is possible to prevent the entry of dust into the engaging grooves after the loading of the cassette and it is possible to effect loading of only such a cassette as is suitable for the loading.

We claim:

1. A winding core which accommodates a web in a wound-up state, said winding core having a winding direction, said winding core having a plurality of engaging grooves formed circumferentially in its inner peripheral surface for engagement with a plurality of engaging projections formed circumferentially at equal intervals on an outer peripheral surface of a winding bobbin of a carriage onto which a cassette is to be loaded, said engaging grooves each having side engaging portions for engagement with side faces of each said engaging projection and an upper engaging portion for engagement with an axial tip face of each said engaging projection in an abutted or covering relation thereto;

said engaging grooves being formed in such a manner that an engaging groove having an engaging groove insertion side at one axial end of the winding core and an engaging groove having an engaging groove insertion side at the opposite end of the winding core are alternately arranged circumferentially at equal intervals; and wherein an engaging guide portion is contiguous to each of said side engaging portions of each said engaging groove at an insertion-side end portion of the engaging groove, said engaging guide portion being formed as a slant face for causing each said engaging projection of the winding bobbin to slide in a relative manner and guiding it into any of the engaging grooves of the winding core.

2. A winding core according to claim 1, wherein said engaging guide portions which connect the insertion-side end portions of engaging grooves having insertion sides at the same end portion of the winding core also serve as the upper engaging portion of an engaging groove having an insertion side at the opposite end portion.

3. A winding core according to claim 2, wherein, out of said side engaging portions of each said engaging groove, the side engaging portion formed on the winding direction side of the winding core is shorter than the side engaging portion formed on the side opposite to the winding direction of the winding core, and said engaging guide portions are each formed as a slant face between the insertion-side end of a side engaging portion formed on the winding direction side of the winding core and the insertion-side end of a side engaging portion formed on the side opposite to the core winding direction of an adjacent engaging groove having an insertion side in the same direction.

4. A winding core according to claim 2, wherein, out of said side engaging portions, the side engaging portion formed on the winding direction side of the winding core is shorter than the side engaging portion formed on the side opposite to the winding direction of the winding core, the engaging guide portion of each said side engaging portion is formed at an insertion-side end of the side engaging portion so as to expand from the associated engaging groove, and a tip end of the engaging guide portion contiguous to the side engaging portion formed on the core winding direction side of each engaging groove is connected with a tip end of the engaging guide portion contiguous to the side engaging portion formed on the side opposite to the core winding direction of an adjacent engaging groove.

5. A winding core according to claim 4, wherein said upper engaging portion of each said engaging groove is in a steepled shape.

* * * * *